US006588487B2

(12) United States Patent
Crafton et al.

(10) Patent No.: US 6,588,487 B2
(45) Date of Patent: Jul. 8, 2003

(54) METHODS AND APPARATUS FOR UTILIZATION OF CHILLS FOR CASTING

(75) Inventors: Scott P. Crafton, Marietta, GA (US); Volker R. Knobloch, Woodstock, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 09/906,317

(22) Filed: Jul. 16, 2001

(65) Prior Publication Data

US 2002/0007931 A1 Jan. 24, 2002

Related U.S. Application Data

(60) Provisional application No. 60/218,755, filed on Jul. 17, 2000.

(51) Int. Cl.[7] ..... B22D 15/00

(52) U.S. Cl. ..... 164/127; 164/352; 164/353; 164/322; 164/137; 164/339

(58) Field of Search ..... 164/127, 125, 164/126, 352, 353, 354, 322, 137, 339

(56) References Cited

U.S. PATENT DOCUMENTS

| | | | | |
|---|---|---|---|---|
| 2,988,351 A | | 6/1961 | Barnett et al. | 263/40 |
| 4,094,181 A | | 6/1978 | Westberg | 72/325 |
| 4,411,709 A | | 10/1983 | Nakanishi | 148/3 |
| 4,499,940 A | | 2/1985 | Hall | 164/36 |
| 4,582,301 A | | 4/1986 | Wunning | 266/87 |
| 4,627,814 A | | 12/1986 | Hattori et al. | 432/128 |
| 4,693,292 A | | 9/1987 | Campbell | 164/34 |
| 4,804,032 A | | 2/1989 | Wilkins | 164/34 |
| 4,807,728 A | | 2/1989 | Suenaga et al. | 188/260 |
| 5,022,458 A | | 6/1991 | Smith | 164/457 |
| 5,027,881 A | | 7/1991 | Horst et al. | 164/443 |
| 5,052,923 A | | 10/1991 | Peter et al. | 432/205 |
| 5,101,880 A | | 4/1992 | Fujiwara et al. | 164/154.4 |
| 5,251,683 A | | 10/1993 | Backer | 164/98 |
| 5,294,094 A | | 3/1994 | Crafton et al. | 266/44 |
| 5,350,160 A | | 9/1994 | Crafton et al. | 266/252 |
| 5,354,038 A | | 10/1994 | Crafton | 266/44 |
| 5,439,045 A | | 8/1995 | Crafton | 164/5 |
| 5,443,383 A | | 8/1995 | Kuehn | 432/122 |
| 5,477,906 A | * | 12/1995 | Legge et al. | 164/122.1 |

(List continued on next page.)

FOREIGN PATENT DOCUMENTS

| | | | | |
|---|---|---|---|---|
| DE | 553653 | | 6/1932 | |
| EP | 0 197 741 | | 10/1986 | B22D/27/20 |
| GB | 2230720 | | 10/1990 | B22D/29/00 |
| JP | 58148046 | | 9/1983 | B22C/9/00 |
| JP | 59078764 | | 5/1984 | B22D/13/00 |
| JP | 61067540 | * | 4/1986 | 164/354 |
| JP | 62-74022 | | 4/1987 | C21D/5/00 |

OTHER PUBLICATIONS

Founding Article—pp. 1–3—Mar. 9, 2001—FunkandWagnalls.com.

Casting Processes—pp. 1–6—Mar. 9, 2001.

Enhancing Aluminum Casting Solidification via Cooling Fins—pp. 1–7—Mar. 9, 2001—T.C.

Wright and John Campbell—University of Birmingham.

*Primary Examiner*—Tom Dunn
*Assistant Examiner*—I. H. Lin
(74) *Attorney, Agent, or Firm*—Womble Carlyle Sandridge & Rice, PLLC

(57) ABSTRACT

Disclosed is both a process and apparatus for forming a molded article. The molded article is formed in a vertically potted flaskless mold. The flaskless mold is closed having an opening in the top portion that receives a chill for directing the cooling of the molten metal introduced into the mold cavity. After the molten metal solidifies and before the mold is broken down, the chill is removed for reuse in the process.

24 Claims, 6 Drawing Sheets

U.S. PATENT DOCUMENTS

| | | | | | |
|---|---|---|---|---|---|
| 5,531,423 | A | | 7/1996 | Crafton et al. | 266/44 |
| 5,533,563 | A | | 7/1996 | Lee, Sr. | 164/127 |
| 5,551,998 | A | | 9/1996 | Crafton et al. | 148/538 |
| 5,565,046 | A | | 10/1996 | Crafton et al. | 148/538 |
| 5,573,057 | A | | 11/1996 | McDonald | 164/58.1 |
| 5,735,334 | A | * | 4/1998 | Sutton et al. | 164/130 |
| 5,738,162 | A | | 4/1998 | Crafton | 164/5 |
| 5,829,509 | A | | 11/1998 | Crafton | 164/5 |
| 5,850,866 | A | | 12/1998 | Crafton | 164/5 |
| 5,857,513 | A | | 1/1999 | Calhoun et al. | 164/159 |
| 5,957,188 | A | | 9/1999 | Crafton | 164/5 |
| 6,112,803 | A | | 9/2000 | Kruger | 164/103 |

* cited by examiner

METHODS AND APPARATUS FOR UTILIZATION OF CHILLS FOR CASTING

CROSS-REFERENCE TO RELATED APPLICATION

This application claims the benefit for U.S. Provisional Application Serial No. 60/218,755, filed Jul. 17, 2000.

TECHNICAL FIELD

This invention generally relates to metallurgical casting processes, and more specifically to a method and apparatus for providing a flaskless mold having removable chills.

BACKGROUND

Casting processes for forming molded or cast articles can employ a vertically potted or horizontally potted mold. A horizontally potted mold traditionally is formed from an upper portion called a cope and lower portion called a drag. A vertically potted mold comprises two halves abutted to each other and generally defining or forming a cavity between the two halves for receiving a molten metal. Additionally, molded articles may be formed by using either a cast iron flask-type mold or a flaskless mold typically comprised of sand and a binder.

Typically, the mold cavity will have features or reliefs formed within mold walls defining the cavity to form desired details or impressions and cavities in the molded articles. For example, such details can form ports and other features of cylinder heads or cylinder blocks. A sand core may also be added to the mold casting to impart further detail to the molded article such as defining contours and interior features within the metal castings. These cores are often comprised of sand and a suitable binder material and are set within the mold cavity prior to the closing of the mold.

Furthermore, metal objects called chills may be placed on the outside or inside of a mold cavity to induce more rapid cooling at the point of insertion or placement. Chills may be used to selectively develop different metallurgical properties throughout portions of the molded article and/or to impart patterns or relief details to the molded article. Typically, the chill is received in a recess formed within the mold cavity and is positioned in the mold such that it will contact the molten metal entering the mold cavity. The chill is placed into the mold before the two halves forming the mold cavity are joined. Once the mold is closed, molten metal is introduced into the mold cavity. The chill cools the molded article in contact with the chill and hardens the area of the molded article immediately adjacent to the chill.

Once the molded article has solidified, both the article and chill generally are removed from the mold by a "shakeout" process or other process where the mold is broken apart and the sand removed. The chill, sand cores and mold are removed from the molded article at the same time. The chill inserts are recovered along with the waste sand that formed the mold. After the chills are recovered, they must be cleaned before being reused. Additionally, the chills can be damaged in the removal process and must be inspected for damage before being reused. Furthermore, recovering the chills with the waste sand requires a surplus of chills, since chills must first be sorted out from the waste sand.

Therefore, there is a need for a process and apparatus for forming molten articles that address the foregoing and other known and unknown problems in the art.

SUMMARY

Briefly described, the present invention comprises both a process and apparatus for forming a molded article. The molded article generally is formed in a vertically potted flaskless mold. A chill is placed into the mold after the mold is closed to direct the cooling of the molded article at a desired area or section of the article. Molten metal is introduced into the mold cavity and allowed to solidify. After solidification, but before the mold is broken down, the chill is removed.

In an embodiment, the method of forming a molded article includes providing a flaskless mold with at least one opening formed or defined in the mold. A chill is placed within the opening to direct the cooling of the molten metal that is introduced into the mold. The chill is then removable from the mold, through the defined opening, before the mold is destroyed. The chill may then be readied for reuse in additional casting operations.

In a further embodiment, the method of forming a molded article includes forming a flaskless substantially vertically potted sand mold with an opening formed in the top portion of the mold. A chill is then placed within the opening for generally directing and/or enhancing the cooling of the molten metal introduced into the mold, at desired portions or sections of the molded article. The chill is then removed before the mold is destroyed.

Additionally, the invention includes a flaskless mold assembly for producing a molded article. The mold assembly includes a first portion having a top surface and a mold joint surface and a second portion having a top surface and a mold joint surface. A mold cavity is defined by at least a part of the mold joint surfaces of the first and second portions. The mold joint surfaces are abutted to one another in a substantially vertical plane forming a vertically potted joint. An opening is formed in the top surfaces of the abutted first and second portions. A chill is then removably positioned or received within the opening of the abutted first and second halves. The chill can then be removed from the mold assembly without substantially destroying the mold.

Various objects, features, and advantages of the present invention will become apparent upon reading and understanding this specification, taken in conjunction with the accompanying drawings.

DETAILED DESCRIPTION

Figure 1:
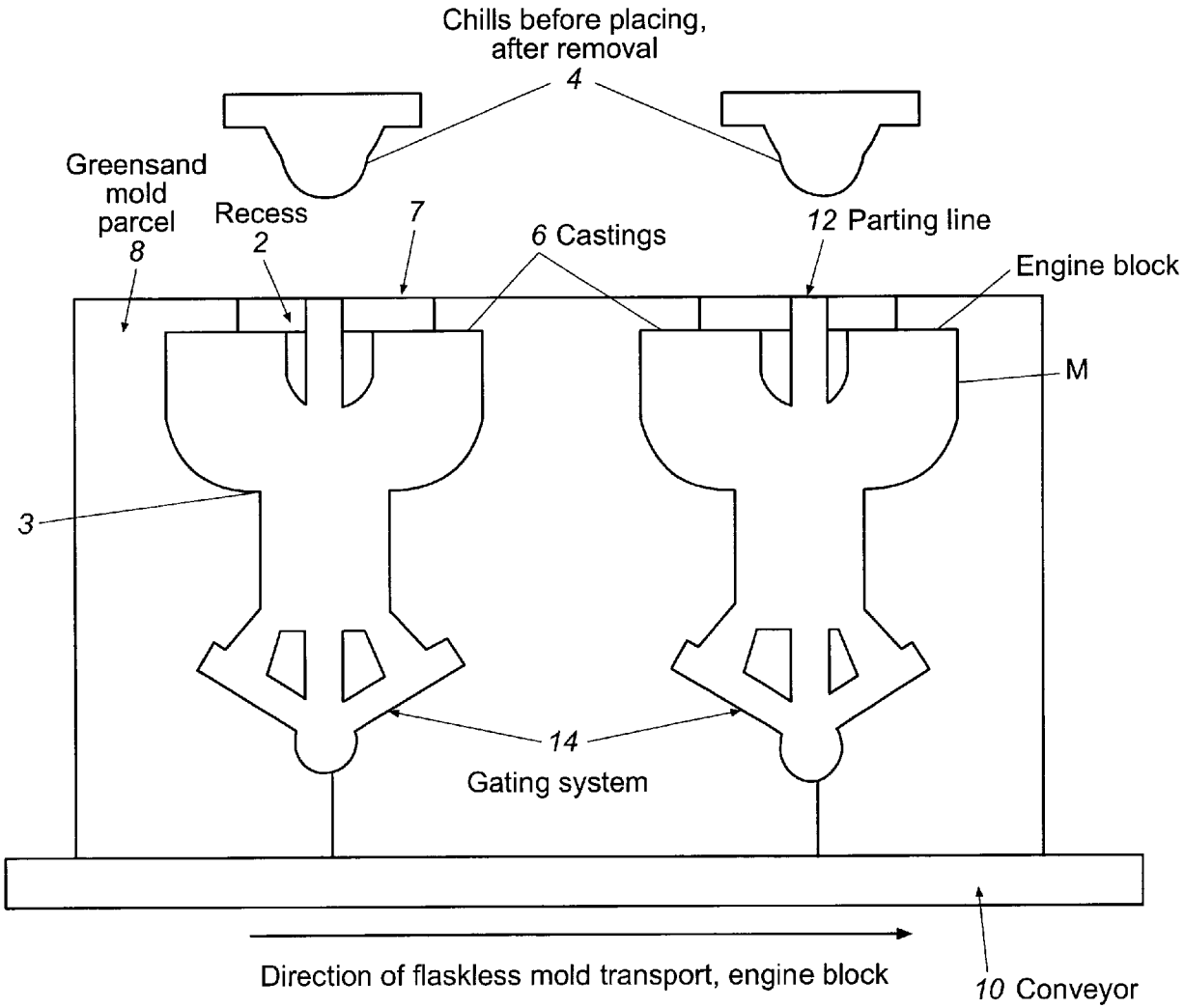
FIG. 1 is a side elevational view illustrating a vertically potted flaskless mold and chills prior to inserting into the mold.

The present invention comprises both a process and apparatus for forming a molded article 6. The molded article 6 generally is formed in a vertically potted flaskless mold such as illustrated at 8 in FIG. 1, which generally includes opposed halves or sections defining a mold cavity 3 therein. The flaskless mold 8 typically is substantially closed, having a bottom portion 5 and a top or upper portion 7, with an opening or receiving recess 2 formed in top portion 7 thereof. At least one chill 4 is generally received and positioned within the opening 6, adjacent the cavity 3 and generally in a position to contact a desired portion or area/section of the molded article being formed within the mold. The chill generally is formed from a metal or composite material having a higher melting point than the material forming the article 6. The chill tends to directs and/or enhance the cooling of the molten metal introduced into the mold cavity. After the molten metal solidifies and before the mold 8 is broken down, the chill 4 generally is removed from the mold via the opening for reuse in additional casting operations.

The formation of sand molds and sand mold castings are generally well known to those skilled in the art and a traditional casting process will be described only briefly for reference purposes. Sand casting typically involves forming a mold from sand and casting a metal part from a molten metal or alloy material poured onto the mold. After the molten metal has hardened and cooled to form the desired part or article, the part is removed from the sand. In greater detail, sand and binders such as clay are mixed together and formed about a pattern created to imprint a patterned mold cavity into the sand. Additionally, gates, runners, risers and pouring cups may be added as needed. Furthermore, sand cores and further relief defining elements such as further chills and similar pieces, may be placed within the mold cavity 3 itself, before the two halves are joined. In the present invention, the chill or chills 4 generally are placed into the mold 8 after it is closed. Once the two halves are joined, the molten metal material M is poured slowly into the mold 8 and allowed to harden to form the desired cast article or part.

It will be understood by those skilled in the art that the present invention includes metal casting processes for forming aluminum, iron, and/or other types of metal and metal alloy castings. The present invention thus is not and should not be limited solely for a particular type or types of metals or metal alloys. The present process may also be carried out in a continuous process wherein the forming, pouring and mold shakedown occur in a continuous process such as on a conveyer line (FIG. 1). Example processes include those disclosed in U.S. Pat. Nos. 5,294,994; 5,565,046; and 5,738,162, and U.S. patent application Ser. No. 09/313,111, filed May 17, 1999, and Ser. No. 09/627,109, filed Jul. 27, 2000, the disclosures of which are incorporated herein by reference.

An example sand material compatible with the present process includes green sand. Green sand or green sand casting molds are formed from unbaked sand or silica $SiO_2$, bonded with water and a quantity of clay. Example clay materials include montmorillonite and kaolinite, but it is understood that any suitable binder may be used to bind the sand together to form a mold. For example resins may be used as known to those skilled in the art. Clay is often used because it absorbs the water to form a natural bonding system that holds the sand particles together and is generally economical to use. Different clays or other binders and sand materials may be blended depending upon the particular desired casting condition.

The term chill refers to an object placed in or on the mold 8 to alter the cooling of the molten part within the mold. Typically, the chill 4 is a metal object placed inside the mold cavity to induce a more rapid cooling at the point of contact with the molten metal inside the mold cavity. The chill 4 may be formed from steel or other suitable metal or composite materials. The chill 4 may also have a pattern imprinted on it for transferring a design onto and into the molded article 6 formed in the mold. Additionally, more than one chill 4 may be used in a mold. The multiple chills 4 may be incorporated directly onto or into the mold 8, or first incorporated into a sand core, which is then placed into the mold recess 2. The sand core generally is a separate part of the mold 8 formed from sand and resin, which is baked and may be used to create various shaped cavities in the molded part.

In one embodiment, the method of forming a molded article 6 generally includes forming a flaskless vertically potted mold. A vertically potted mold is one where the molded article 6 is shaped or formed inside the mold perpendicular to the horizon or primary axis. This is in contrast to molds comprising an upper portion known as a cope and a lower portion known as a drag. A further definition of a vertically potted mold may include a mold having a joint or parting line 12 that runs perpendicular to the horizon.

In an embodiment, the mold 8 is typically formed from sand and a binder, such as a clay binder as previously disclosed. Within the sand mold 8, a mold cavity 3 is formed or defined by joining at least two molded parts or sections along the joint or parting line 12, with a receiving recess 2 or opening further being formed in the top portion of the mold. At least one chill, or a series of chills 4 is placed within the opening or recess 2 to direct and/or enhance the cooling of the molten metal that is introduced into the mold. The chill 4 is removably placed within the recess 2 such that it can be readily removed from the mold 8 before the mold 8 is destroyed and with the risk of damaging the cast article, the mold and/or the chill being minimized. A core formed from sand and resin may also be inserted into the mold 8 before or after the closing of the mold 8. The chill 4 when inserted within the opening or recess 2 may substantially fill the opening to substantially close the mold 8. The inserted chill 4 may impart a pattern to the molded article 6 and directs the cooling of the molten metal introduced into the mold at desired points or regions of the article being cast to affect its properties and/or gain structure at such locations, and/or to produce desired relief details, openings or recesses in the finished article.

In a further embodiment, the method of forming a molded article 6 includes forming a flaskless substantially vertically potted sand mold 8 with an opening formed in the top portion of the mold 8. A chill 4 is then placed within the opening directing the cooling of the molten metal introduced into the mold 8. The chill 4 is then removed before the mold 8 is destroyed. By removing the chills 4 before destroying the mold, the chills 4 may be available for immediate reuse in the present process. Additionally, damage to the chills 4 is prevented by removing them before the mold is destroyed. Furthermore, the number of chills 4 needed in the process is reduced since they are quickly made available after being removed before the mold tear-down stage.

Additionally, the invention includes a flaskless mold assembly for producing a molded article 6. As shown in FIGS. 1, 2, 5, and 6, the mold assembly includes a first portion having a top surface 7 and a mold joint surface 15, and a second portion having a top surface 7' and a mold joint surface 15' that come together at the mold joint or parting line 12. The mold cavity is defined by at least a part of the mold joint surfaces of the first and second portions. The mold joint surfaces are abutted to one another in a substantially vertical plane forming a vertically potted joint. An opening or recess 2 (FIG. 1) generally is formed in the top surfaces of the abutted first and second portions. A chill 4 is then removably positioned within the opening of the abutted first and second halves. The chill 4 can then be removed from the mold assembly without substantially destroying the mold.

Figure 2:
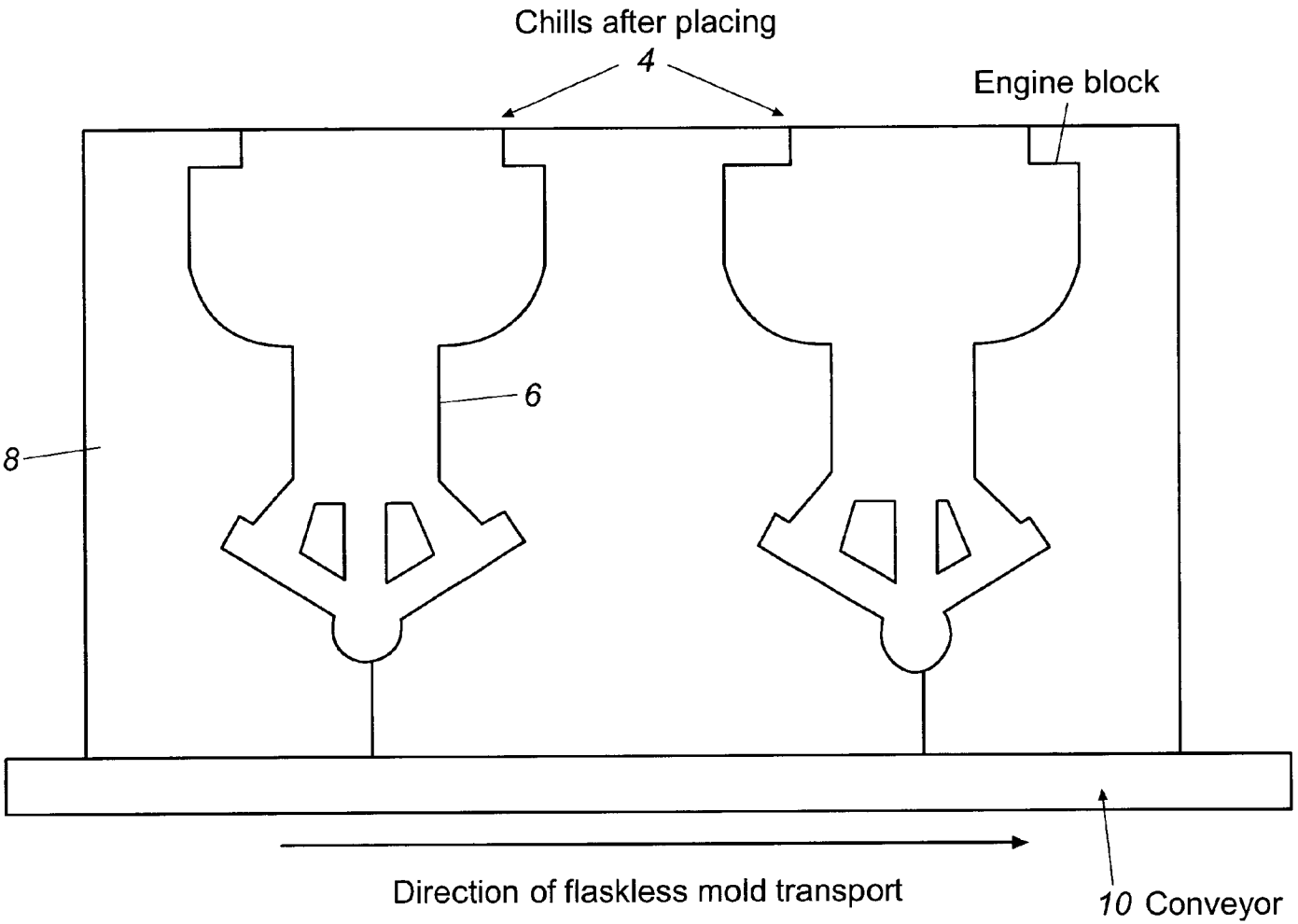
FIG. 2 is a further illustration of a side elevation view illustrating insertion of the chills into the mold.

Referring now in greater detail to the drawings in which like numerals refer to like parts throughout the several views, FIG. 1 illustrates a vertically potted mold 8 and molded article 6 encased in the sand and binder mold prior to the insertion of the chills 4. Within this illustration the mold 8 is formed on a conveyor 10 wherein the molded article 6 can be formed in a continuous process. Additionally illustrated is a gating system 14 formed within the mold 8 for delivering the molten metal to the bottom portion of the mold. The molded article 6 shown in FIG. 1 is an engine block. The chill 4 fits within the recess 2 and is shaped to form an indentation within the molded article 6 or to further mold the article. Also illustrated is the mold joint or parting line 12. A robotic arm or mechanical grasping device may be used to place or remove the chills from the mold that is not illustrated. FIG. 2 illustrates a similar vertically potted mold as in FIG. 1 except that the chill 4 has been inserted into the recess 2.

Figure 3:
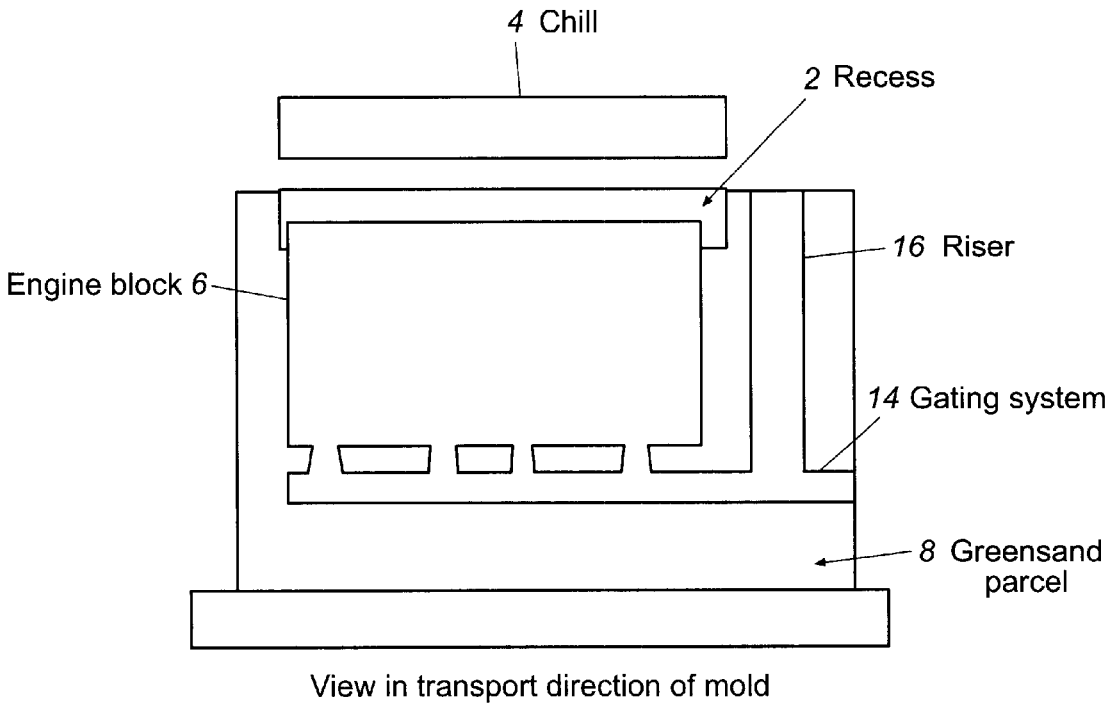
FIG. 3 is an end view illustrating a molded article in a mold having a riser and grating system and a chill before it is placed into the closed mold.
Figure 4:
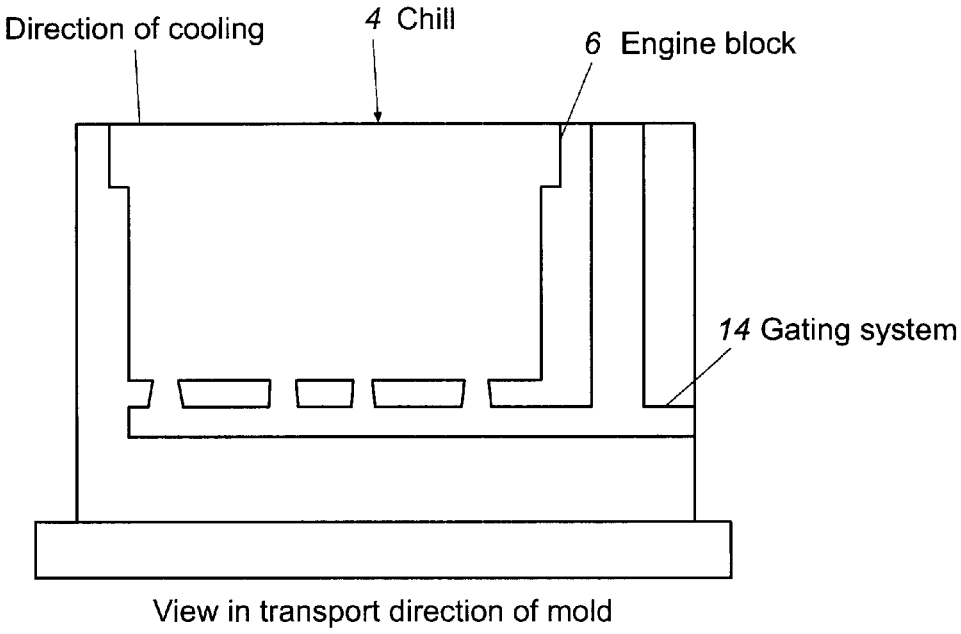
FIG. 4 is a further illustration of the molded article in a mold having a riser and grating system and with the chill placed in the mold.

FIG. 3 illustrates the molded article 6 as an engine block formed within a mold 8 that generally comprises a recess 2 formed in the upper portion for receiving the chill 4 to direct the cooling of the molded article 6. The mold further comprises a riser 16 and gating system 14 for introducing a molten metal into the cavity formed within the mold. FIG. 4 further illustrates that shown in FIG. 3 with the chill 4 inserted within the recess 2.

Figure 5:
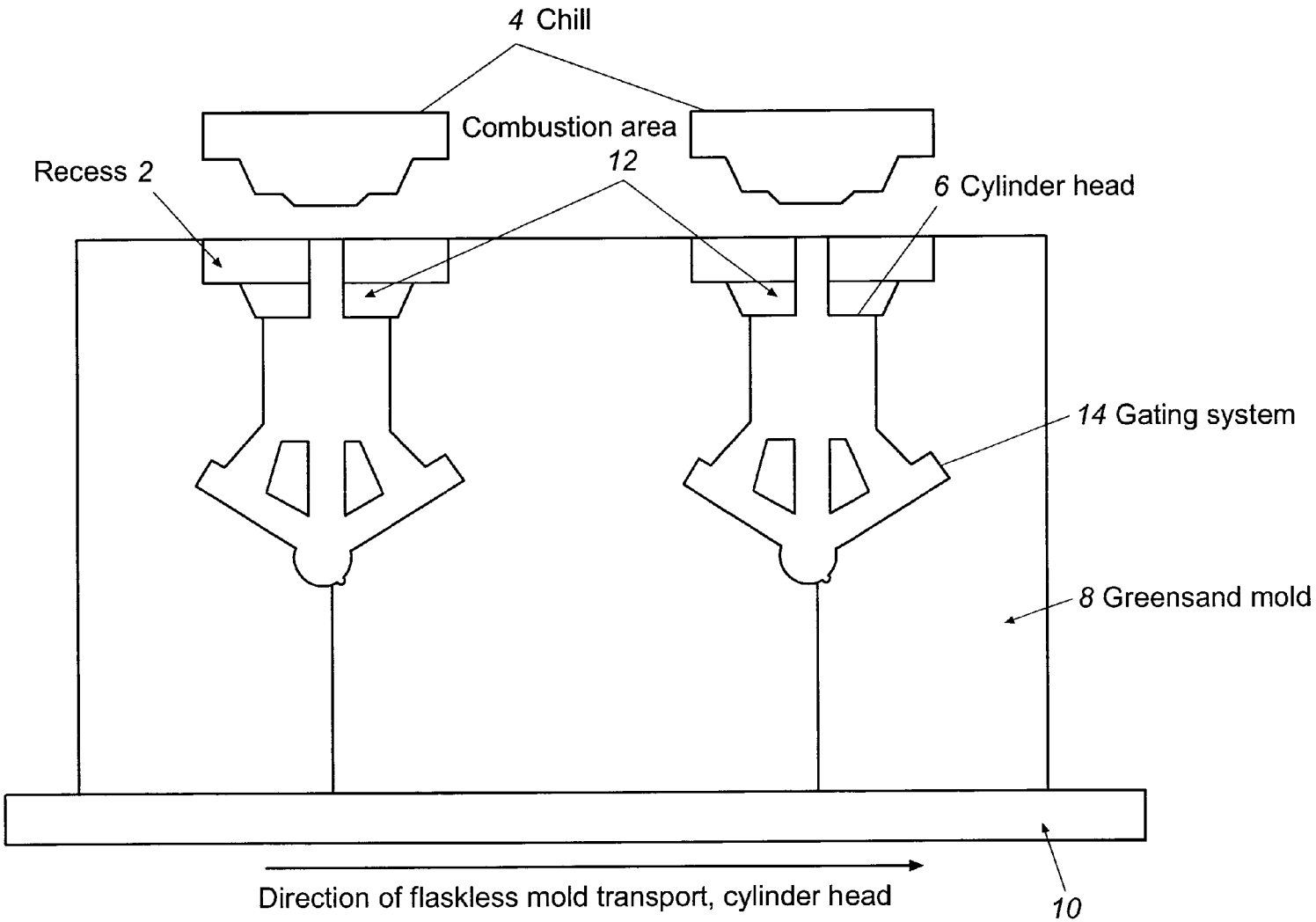
FIG. 5 is a side elevational view illustrating a molded article in a mold and recess before the chills are placed into the mold.
Figure 6:
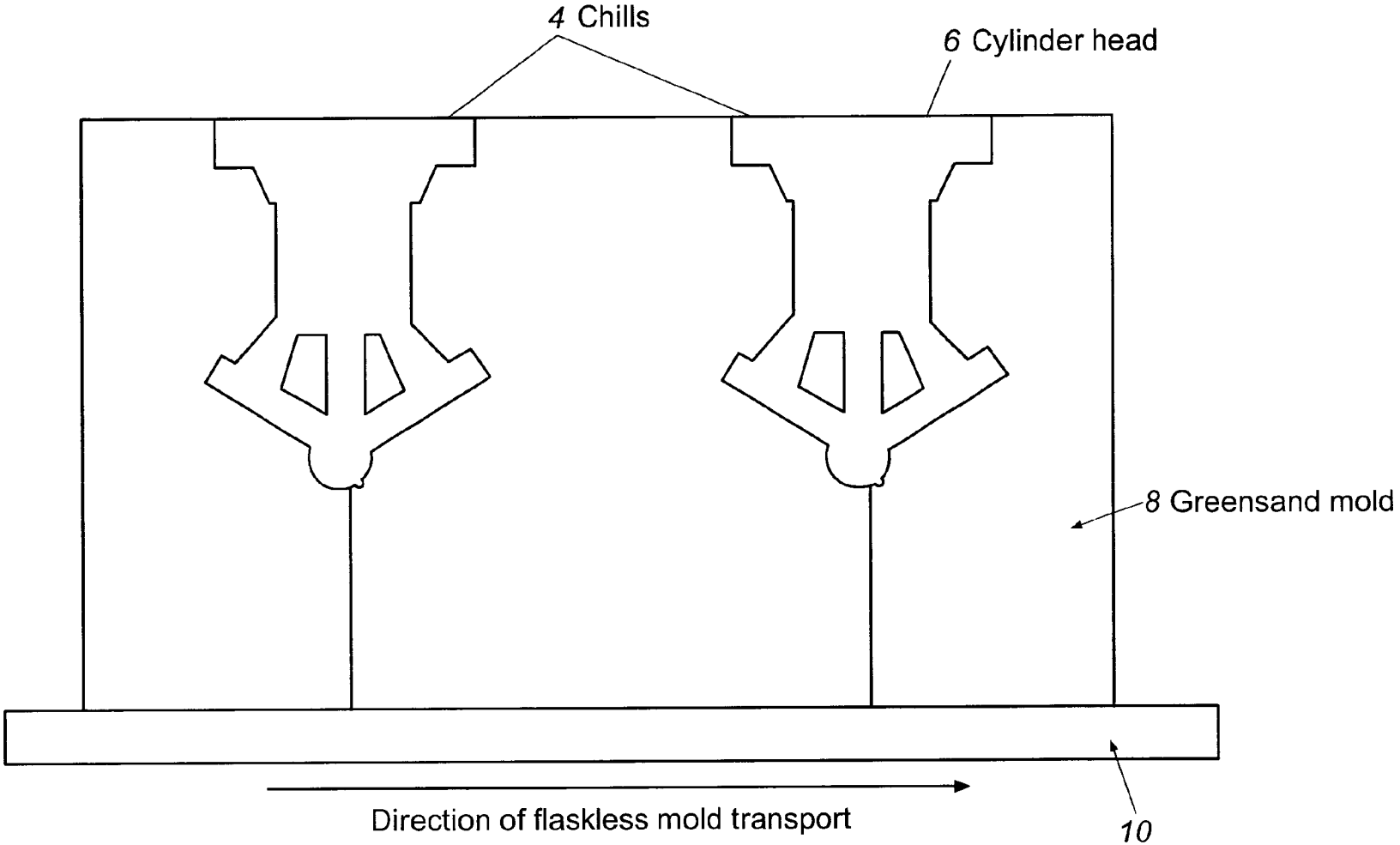
FIG. 6 is a further side view illustrating a molded article in a mold with a gating system and recess having a chill placed within the recess of the mold.

FIG. 5 illustrates the molded article 6 as a cylinder head formed within the cavity of the mold. The chill 4 is shown before insertion into the recess 2 formed in the sand and binder mold. The mold 8 is placed on a conveyor 10 wherein the molded article 6 can be formed as part of a substantially continuous casting process for pouring and then heat treating and breaking down and removing the mold. Additionally illustrated is a gating system 14 formed within the mold 8 for delivering the molten metal to the bottom portion of the mold. The chill 4 fits within the recess 2 and is shaped to further form the cylinder head 6. Also illustrated is a parting line 12. FIG. 6 illustrates a similar vertically potted mold as in FIG. 1 except that the chill 4 has been inserted into the recess 2.

Figure 7:
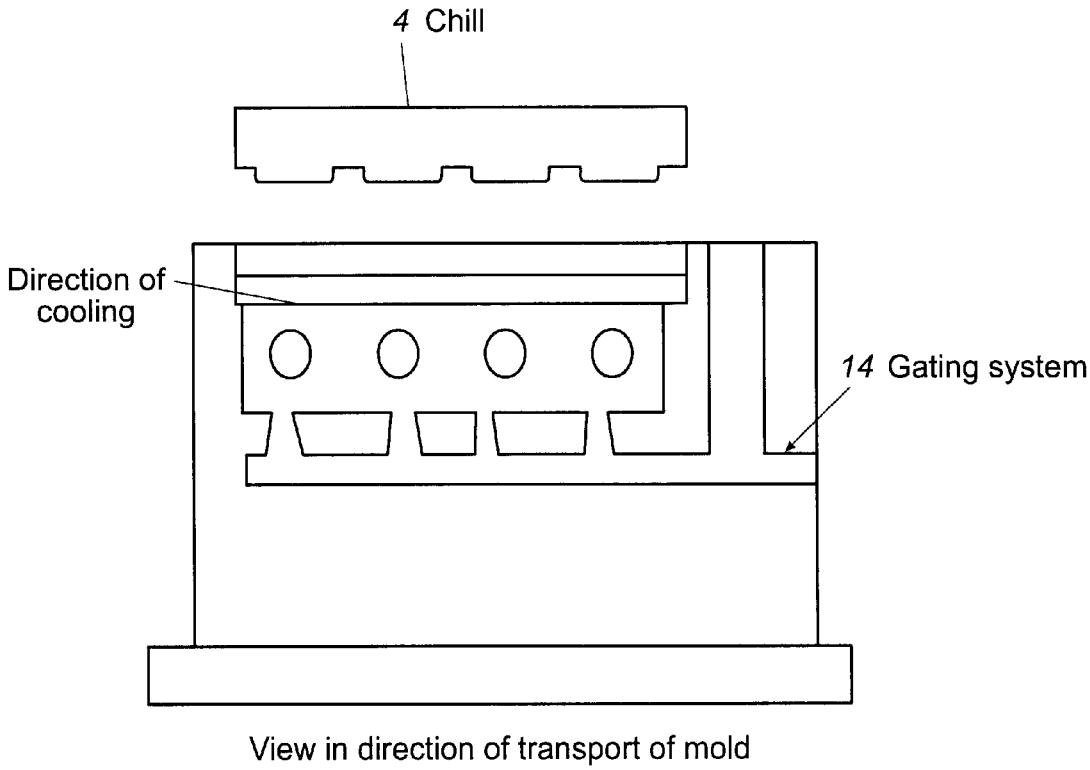
FIG. 7 is an end elevational view of the mold and gating system and sand cores placed within the mold before the insertion of the chill.
Figure 8:
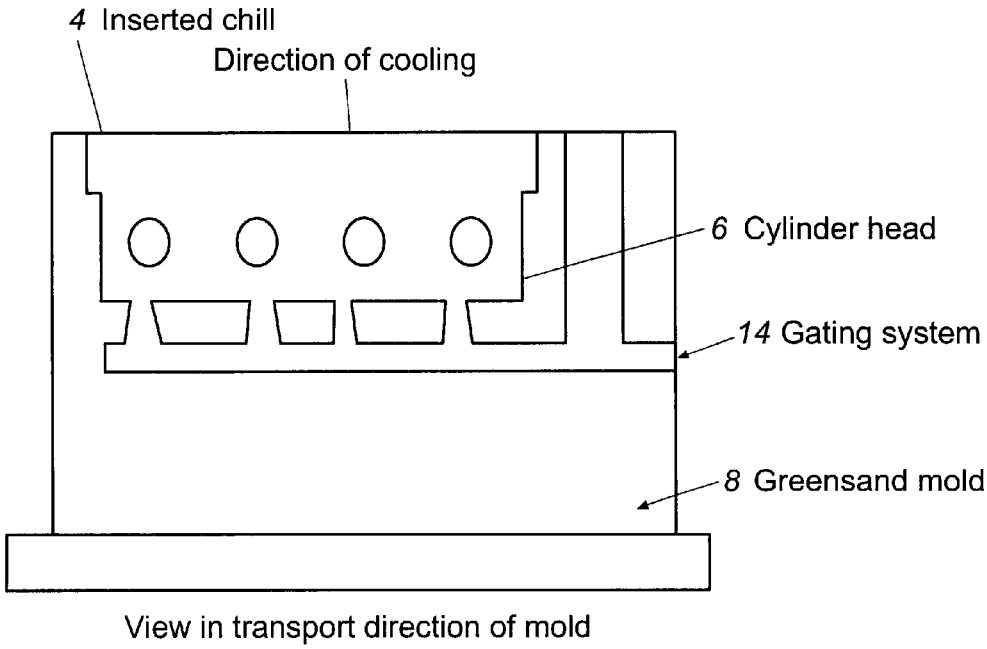
FIG. 8 is a further view of the mold and gating system and sand cores placed within the mold with the insertion of the chill.

FIG. 7 illustrates the molded article 6 as a cylinder head formed within the vertically potted mold. The mold 8 comprises a recess 2 formed in the upper portion for receiving the chill 4 to direct the cooling of the molded article 6. The mold 8 further comprises a riser 16 and gating system 14 for introducing a molten metal into the cavity formed within the mold. The chill 4 further comprises raised areas for further forming the molded article 6. FIG. 8 further illustrates that shown in FIG. 7 with the chill 4 inserted within the recess 2.

It will be understood by those skilled in the art that while the present invention has been discussed above with reference to preferred embodiments, various additions, modifications and changes can be made thereto without departing from the spirit and scope of the invention as set forth in the following claims.

What is claimed is:

1. A method of forming a molded article comprising:

providing a flaskless mold having a top portion and a bottom portion and defining a mold cavity;

forming an opening in the mold in a portion adjacent the mold cavity;

placing a chill within the opening;

introducing a molten metal into the mold; and removing the chill before destroying the mold.

2. The method of claim 1, wherein the opening is formed in the top portion of the mold.

3. The method of claim 1, further comprising forming a recess within the opening.

4. The method of claim 1, wherein the chill substantially fills the opening to substantially close the mold.

5. The method of claim 1, further comprising the chill imparting a pattern to the molded article.

6. The method of claim 1, wherein the mold is substantially vertically potted from the top portion to the bottom portion.

7. The method of claim 1, wherein the mold comprises a binder and sand.

8. The method of claim 1, further comprising directing the cooling of the molten metal within the mold.

9. The method of claim 1, further comprising placing a core within the mold.

10. The method of claim 1, where the chill is removed from the mold using a robotic arm.

11. A method of forming a molded article comprising:

forming a flaskless substantially vertically potted sand mold;

forming an opening in a top portion of the mold;

placing a chill within the opening;

introducing a molten metal into the mold; and removing the chill before breakdown of the mold.

12. The method of claim 11, further comprising forming a recess within the opening.

13. The method of claim 11, wherein the chill substantially fills the opening to substantially close the mold.

14. The method of claim 11, further comprising the chill imparting a pattern to the molded article.

15. The method of claim 11, wherein the mold comprises a binder and sand.

16. The method of claim 11, further comprising directing the cooling of the molten metal within the mold.

17. The method of claim 11, further comprising placing a core within the mold.

18. The method of claim 17, wherein the core comprises sand and a resin binder.

19. A flaskless mold assembly for producing a molded article comprising:

a first portion having a top surface and a mold joint surface;

a second portion having a top surface and a mold joint surface;

a mold cavity defined by at least a part of the mold joint surfaces of the first and second portions, wherein the mold joint surfaces are abutted to one another in a substantially vertical plane;

an opening formed in the top surfaces of the abutted first and second portions; and a chill removably positioned within the opening of the abutted first and second halves, wherein the chill can be removed from the mold assembly without substantially destroying the mold.

20. The flaskless mold assembly of claim 19, wherein the mold comprises a binder and sand.

21. The flaskless mold assembly of claim 19, wherein the chill comprises a metal.

22. The flaskless mold assembly of claim 19, wherein the chill comprises an imprinted design to form internal parts of the molded article.

23. The flaskless mold assembly of claim 19, further comprising a core within the mold.

24. The flaskless mold assembly of claim 23, wherein the core comprises sand and a resin binder.

* * * * *